United States Patent [19]

Erickson

[11] Patent Number: 5,033,735

[45] **Date of Patent: * Jul. 23, 1991**

[54] AQUATIC EXERCISE DEVICE

[75] Inventor: Curtis Erickson, Palm City, Fla.

[73] Assignee: Hydrosplash Enterprises, Inc., Palm City, Fla.

[ * ] Notice: The portion of the term of this patent subsequent to Oct. 24, 2006 has been disclaimed.

[21] Appl. No.: 424,702

[22] Filed: Oct. 20, 1989

Related U.S. Application Data

[63] Continuation of Ser. No. 126,470, Nov. 27, 1987, Pat. No. 4,875,673.

[51] Int. Cl.[5] ..... A63B 31/00; E04H 3/18

[52] U.S. Cl. ..... 272/71; 272/1 B; 272/63; 4/496

[58] Field of Search ..... 272/71, 134, 1 B, 62, 272/63, 93, 118, 109, 900, 144; 434/254; 4/504, 488, 496

[56] References Cited

U.S. PATENT DOCUMENTS

| | | | |
|---|---|---|---|
| 3,090,489 | 5/1921 | Smith | 4/496 |
| 3,430,954 | 4/1969 | Massey | 272/62 |
| 3,724,012 | 4/1973 | Sanderson | 272/71 |
| 3,874,657 | 4/1975 | Niebojewski | 272/63 |
| 4,538,807 | 9/1985 | Rice | 272/134 |
| 4,620,701 | 11/1986 | Mojden | 272/73 |
| 4,733,860 | 3/1988 | Steffee | 272/134 |
| 4,875,673 | 10/1989 | Erickson | 272/71 |

OTHER PUBLICATIONS

Universal Physical Conditioning Equipment-1981, Rec'd in Grp 330 5-11-82, see pp. 6, 8, 10, 11.

*Primary Examiner*—Stephen R. Crow
*Attorney, Agent, or Firm*—McAulay Fisher Nissen & Goldberg

[57] ABSTRACT

An aquatic exercise device wherein several embodiments are disclosed. The first embodiment utilizing a unitary aquatic exercise device which is adaptable for use with a conventional pool ladder. The second embodiment is directed to a unitary aquatic exercise device which is adaptable for use with an inverted pool ladder. Both of these embodiments are readily placed in the vertical position when not in use and are also readily removable from the pool when so desired. A third embodiment utilizes a unitary aquatic device which includes mounting legs that are permanently mounted in recesses of the pool decking. All of these embodiments are made of lightweight PVC components eliminating any corrosion problems and also rendering the device readily cleanable.

17 Claims, 5 Drawing Sheets

AQUATIC EXERCISE DEVICE

This is a continuation of application Ser. No. 126,470 filed Nov. 27, 1987, now U.S. Pat. No. 4,875,673.

BACKGROUND OF THE INVENTION

Due to the relatively recent awareness of advantages of physical fitness throughout the world there has been an increase in exercise by individuals. Exercising can take any of many forms, for example, jogging, biking, tennis, etc. In addition to these forms of exercise there has been an upsurge of health clubs, fitness centers and the like which have come into being in recent years. Most of these fitness centers consist of a gym-like environment wherein members can come to work out on the various types of exercise machines and other exercise equipment. However, all these exercises are undertaken in a non-aquatic environment. It is well known that exercising in an aquatic environment is more beneficial to the person doing the exercise because the invention employs the resistive force of water to promote muscle tone, while utilizing the bouyancy of water to reduce the likelihood of muscle stress. Exercising in an aquatic environment is also more invigorating and motivating due to the coolness of the pool water and also the clean smell of chlorine. With these ideas kept in mind, applicant has developed an aquatic exercise apparatus which is readily adaptable to any of the conventional swimming pools found in our affluent society today.

SUMMARY OF THE INVENTION

The present invention is drawn to an aquatic exercise apparatus which is readily adaptable to a conventional swimming pool. One of the many advantages of the invention is that the apparatus can be removably attached to either a conventional pool ladder or when an adapter is employed, it is adaptable to an inverted pool ladder. A further embodiment permits a permanent mounting of the exercise apparatus in the pool decking and provides its own support rather than relying on either of the two aforementioned types of ladder for its support. The exercise apparatus is mounted in such a manner that the person using the apparatus is in the pool enjoying the cool feeling of being in the water. The instant invention permits almost unlimited types of exercises. For example, chin-ups, sit-ups, leg butterflys, leg kicking, etc. can be performed with this apparatus.

OBJECTS OF THE INVENTION

It is an object of the present invention to provide an economical exercise device which is readily adaptable to a conventional swimming pool.

Another object provides an apparatus which is lightweight and readily removed from the pool, if so desired.

A further object is to enable the apparatus to be moved to a non-use or stored position.

A still further object of the invention is to provide an adapter which is used with an inverted pool ladder to provide support to the exercise apparatus.

Yet another object of the invention is the provision of an embodiment which can be permanently mounted on the pool decking.

A further object of the invention is the provision of an apparatus wherein a complete exercise program can be performed providing maximum benefit to the user.

Still another object of the invention is to provide an apparatus which is useful as a therapeutic device to restore muscle strength lost as a result of accidents, injuries or surgery.

These and other objects of the instant invention will become more apparent hereinafter, the instant invention will now be described with particular reference to the accompanying drawings which form a part of this specification wherein like reference characters designate the corresponding parts in the several views.

DETAILED DESCRIPTION OF THE PREFERRED EMBODIMENT

Figure 1:
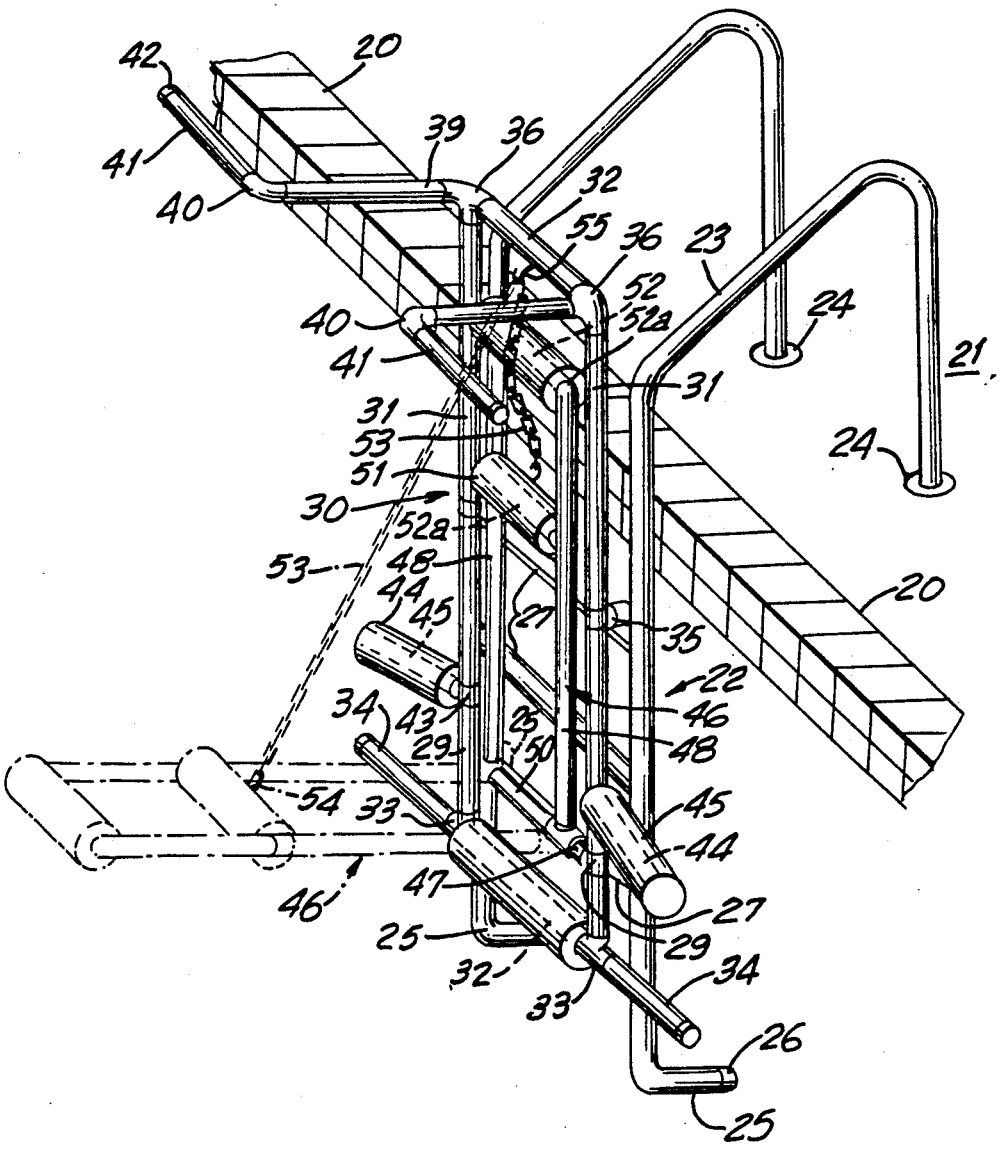
FIG. 1 is a perspective view of the aquatic exercise apparatus supported by a conventional pool ladder.

Referring now to FIG. 1 of the drawings wherein the aquatic exercise apparatus is shown as being supported by a conventional ladder found in most swimming pools today. A portion of the pool coping tiles 20 along with the concrete decking 21 are shown as well as the conventional ladder 22. Ladder 22 consists of a pair of handrails 23, the upper ends of which are received in a pair of apertures (not shown) in concrete decking 21. A pair of circular disks 24 are inserted over the ends of handrails 23 before they are inserted into the decking apertures. The apertures are provided with conventional mechanical locking means securely positioned in the concrete that are tightened after the end of handrails 23 are inserted therein. Circular disks 24 merely slide down the rails 23 to cover the locking means. The lower end of each handrail 22 is provided with an inwardly directed support leg 25 which has rubber cap 26 mounted thereon. Support leg 25 provides support for the ladder and keep it in a vertical position at a predetermined distance from the vertical walls of the pool. Positioned horizontally between handrails 23 are a plurality of spaced steps 27.

Removably mounted on ladder 22 is the aquatic exercise apparatus 30 which comprise a pair of spaced vertical frame members 31 and a pair of horizontal frame members 32. The lower horizontal frame member 32, shown in broken lines, is connected thereto by means of a pair of lower T-fittings 33 and is provided with a cylindrical foam sleeve 32A to provide a padding effect to the user of the apparatus. Projecting horizontally from the third opening of each lower T-fitting 33 is a capped lower horizontal extension member 34 which abuts against the front face handrail 23 to stabilize the exercise apparatus 30. Each vertical frame member 31 is provided with a four-way fitting 29 with the two aligned openings positioned to receive vertical members 31 while the third opening receives lower J-hook 35 and a fourth opening receives one end of horizontal member 50 of exercise platform 46. The upper pair of J-hooks 35 which extend inwardly from each vertical member 31 are provided with a short downwardly extending piece 35A of PVC tubing which receives swivel 35B. After sliding swivel 35B onto the short piece 35A of PVC tubing, the tubing is capped to prevent swivel 35B from falling off. The purpose of swivel 35B is to position the apparatus relative to the ladder 22. After placing the J-hook 35 over the upper step 27, swivel 35B is rotated into position under the step, thus preventing upward buoyant movement of the apparatus, see FIG. 5. The uppermost end of each vertical frame member 31 is provided with a three-way fitting 36. Each three-way fitting 36 is connected to a 90° elbow 37 which is connected by an upper horizontal member 38. Each upper T-fitting 36 is also provided with a forward extension 39. A pair of 90° elbows 40 are connected to forward extensions 39 to provide support for horizontal extension member 41. End caps 42 are utilized to close the ends of upper horizontal extension 41. A short distance above the lower pair of J-hooks 35 are another pair of T-fittings 43 with canted extension members 44, shown in broken lines. Cylindrical foam sleeves 45 are mounted on canted extension members 44 to provide comfort to the apparatus user.

Pivotably mounted within the confines of vertical frame members 31 is exercise platform 46. Lowermost end of exercise platform 46 is pivotably connected to horizontal member 50 by a pair of swivel fittings 47. Exercise platform 46 comprises a rectangular frame formed from a pair of spaced long members 48 that are interconnected by three horizontal platform members 50, 51 and 52. Upper horizontal platform member 52 is connected to long platform members 48 by two 90° elbows. While intermediate platform member 51 is interconnected with long platform member by a pair of T-fittings. Both upper and intermediate platform members 52 and 51 respectively are provided with cylindrical foam sleeves 52A.

As illustrated in FIG. 1, exercise platform is shown in its vertical or non-use position. Support chain 53 is attached at one end to eye bolt 54 and to hook 55 at the other end. When exercise platform 46 is desired to be used, one merely unhooks the link attached to hook 55 and allows platform 46 to fall to the position shown by the broken lines, then re-engaging the appropriate link of support chain with hook 55. It is to be noted, that all structural members of the aquatic exercise apparatus are made of conventional PVC pipe and fittings to eliminate any corrosion problems and also to provide a lightweight apparatus which can readily be mounted or de-mounted. All portions of the apparatus which undergo stress are reinforced with galvanized tubing the outside diameter of which substantially conforms to the internal diameter of the PVC members forming the apparatus. The galvanized tubing is cut to the appropriate length and inserted into the PVC tubing before the joints are made up. Another advantage of selectively using the galvanized tubing insert is that it adds sufficient weight to the overall apparatus to overcome the buoyancy of the unit when placed in the water. Support chain 53 is likewise made of steel links which are plastic coated to resist corrosion. Eye-bolt 54 and hook 55 are made of stainless steel to resist corrosion. All joints between the fittings and tubular members are made fast by using the appropriate adhesives which would react with the PVC and form a bonded joint when dry.

Figure 2:
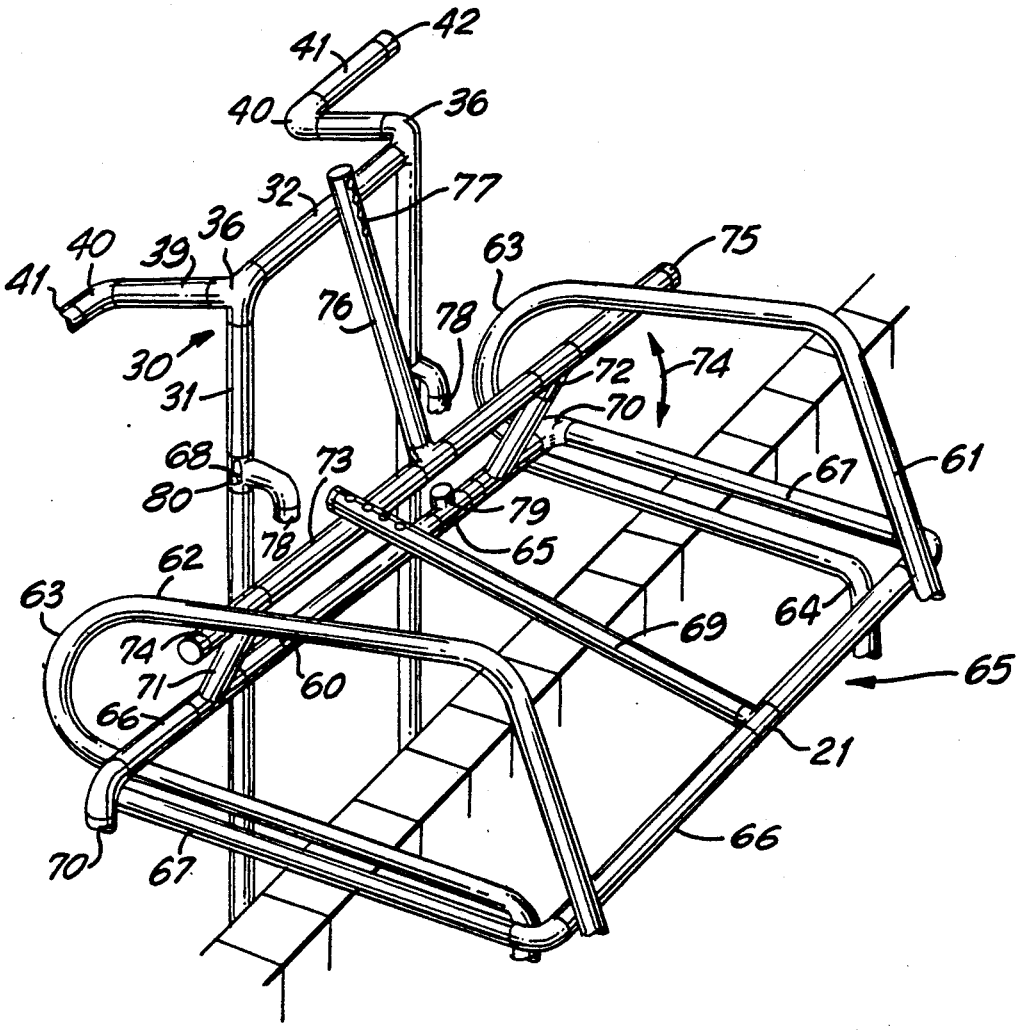
FIG. 2 is a perspective view of the aquatic exercise apparatus and adapter for use with an inverted pool ladder.

Referring now to FIG. 2 wherein an inverted ladder 60 is illustrated as comprising two handrails 61. Each handrail consists of a single continuous tubular member which rises from the concrete decking 21 with a slightly angled portion 61. Then changing to a horizontal run 62, followed by a curved portion 63 and then changing to anothr horizontal run 64 with a downward end which re-enters concrete decking 21. Although not visible in FIG. 2, the vertical concrete wall of the pool is provided with steps which are formed therein at spaced intervals when the pool is being constructed. Since the steps that are used with the inverted ladder are built into the pool wall, a means for supporting the aquatic exercise apparatus has to be provided. The support frame shown at 65 consists of a rectangular frame formed by a first pair of tubular members 66 and a second pair of tubular members 67 which are connected at their right hand ends by means of a pair of 90° elbows. However, before the connection is made, a first swivel fitting 68 is slid over tubular member 66. First swivel fitting 68 provides support for first locking arm 69, the purpose of locking arm 69 will be described later in connection with the procedure for securely mounting support frame 65 in place. The left ends of the second pair of tubular members 67 are connected with the second tubular member 66 by means of a pair of three-way fittings 70. Three-way fittings 70 have two openings on the same plane which are used to interconnect members 67 with member 66. The third opening of three-way fittings 70 is formed as a downward projection of the fitting 70. These downward projections abut the outside of second tubular members 64 to prevent any lateral shifting of support frame 65 relative to inverted ladder 60. Before second tubular member 66 is inserted into three-way fittings 70 four swivel fittings 68 are slid onto tubular member 66, then the joints at three-way fittings 70 can be made up. The outermost swivel fitting 68 at each end of tubular member 66 receives a short piece of PVC pipe 71, the opposite end of which receives a T-fitting 72 with the remaining two open ends of each T-fitting 72 receiving a section of PVC tubing. Inner ends of T-fittings 72 receive center tubular member 73, again, before making up the joints with T-fittings 72 another swivel fitting 68 is slid over tubular member 73. The outer opening of each T-fitting 72 receives an outer tubular member 74 which is provided with a cap 75 at its free end. Projecting upward from the swivel joint 68, which is positioned on center tubular member 73, is second locking arm 76. Both locking arms 69 and 76 are provided with a plurality of spaced apertures 77 on the other side of their respective distal ends. The purpose of these locking arms 69, 76 will be further discussed below. The use of swivel fittings 68 provides adjustability as well as rotatability of the fitting relative to the tubular member which it is mounted on, i.e. the swivel fitting can slide axially relative to the tubular member it is mounted on as well as rotate thereon. For example, outer swivel fitting 68 on forward tubular member 66 allows the upper structure supported by swivel fitting 68 to pivot up or down, allowing it to be collapsed into a storage or non-use position or pivot upwardly until outer tubular members 74 engage the underside of upper horizontal run members 62 to lock the support frame 65 in its position. When this is done, apertures 77 are engaged with a locking pin (not shown) to firmly lock it in place.

Aquatic exercise apparatus 30 is the same as that previously described with respect to FIG. 1 above, with the exception of how it is mounted. In the embodiment of FIG. 2, J-hooks 35 of FIG. 1 are replaced with swivel fittings 68 that are connected to 90° elbows 77 which have short tubular projections 78 mounted therein. Projections 78 are received in the open end of 79 of swivel fitting 68 which are mounted on tubular members 66. Once the aquatic exercise apparatus 30 is positioned at the desired location relative the support frame 65, apertures can be drilled through swivel fittings 68 and tubular member 66 to receive bolts 80 to lock fittings 68 in their desired position. After first locking arm 69 has been locked in its position, exercise apparatus can be suspended therefrom by inserting extensions 78 into opening 79 of swivel fittings 68.

Finally, second locking arm 76 is pivoted into biasing engagement with horizontal member 32 which is provided with a locking pin (not shown) which projects therethrough and is received in one of several adjusting apertures 77 which are drilled through the bottom of second locking arm 76. Here again, when locking arm 76 is locked in position with its pin, arm 76 will maintain the desired pressure on upper horizontal member 32 and pivots the entire exercise apparatus until support legs 25 engage the wall of the pool.

Figure 3:
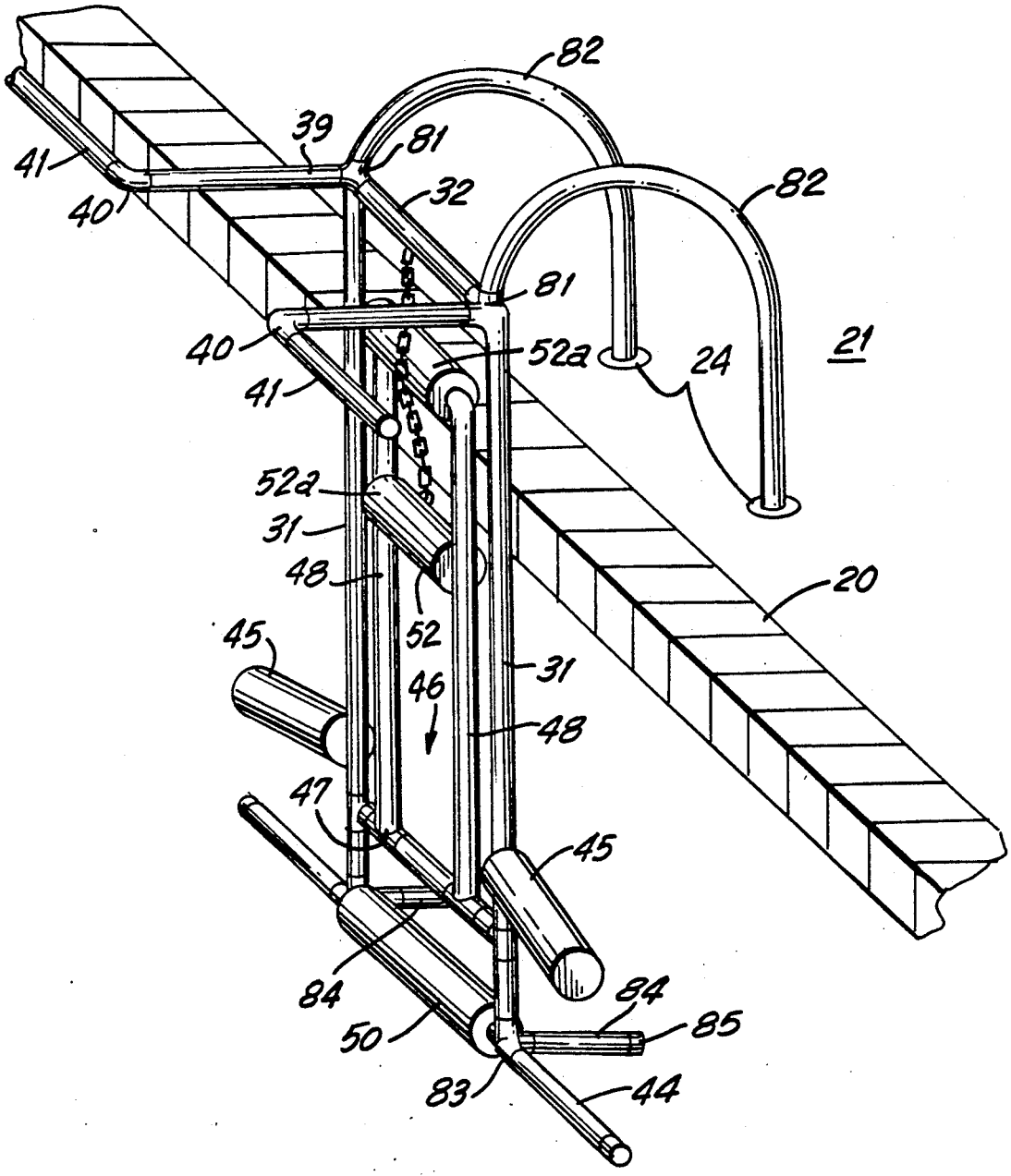
FIG. 3 is a perspective view of the aquatic exercise apparatus with its own permanent support.

Referring now to FIG. 3 wherein aquatic exercise apparatus 30 is shown as a permanently mounted structure in a pool. The details of the exercise apparatus are the same as that described in FIG. 1. However, the manner of mounting is different. In FIG. 3, the uppermost and lowermost ends of vertical frame members 31 are provided with a four-way fitting 81. Three of the openings of four-way fitting 81 are utilized in the same manner as the three-way fitting 36 of FIGS. 1 and 2. The fourth opening at the top of fitting 81 receives the free end of curved tubular member 82 with the other end of curved tubular member 82 being anchored in concrete decking 21. The lower three-way fittings 33 are replaced by lower four-way fittings 83 with the fourth opening receiving support leg 84 with end caps 85 mounted thereon.

Figure 4:
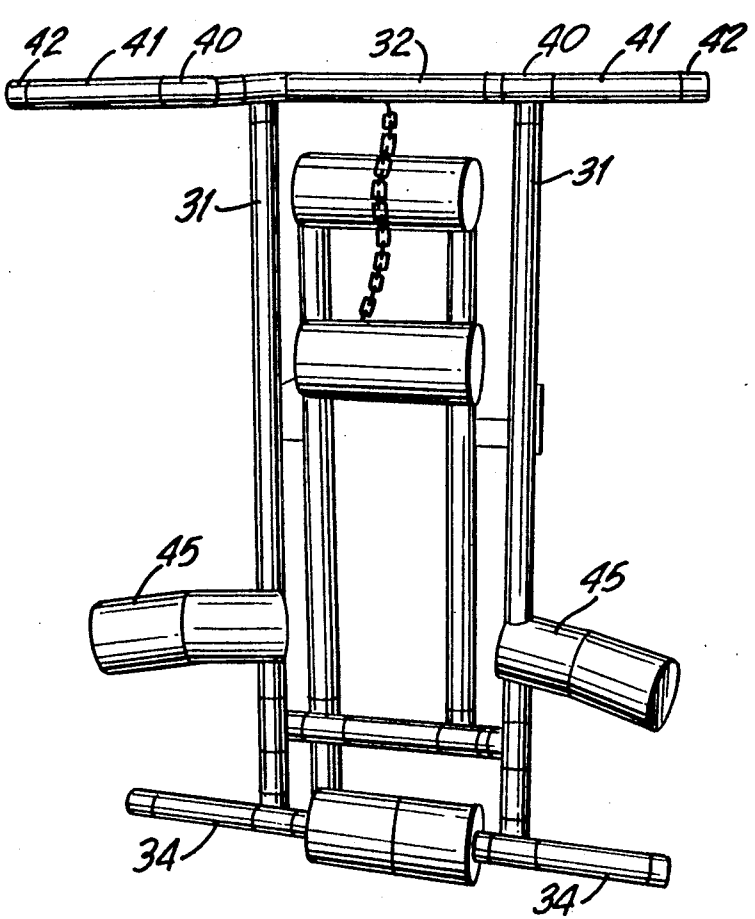
FIG. 4 is a front view of the aquatic exercise apparatus with the platform in its raised position.

FIG. 4 is a frontal illustration of exercise apparatus 30 prior to being inserted into the pool. Exercise platform 46 is shown in its stowed vertical position.

Figure 5:
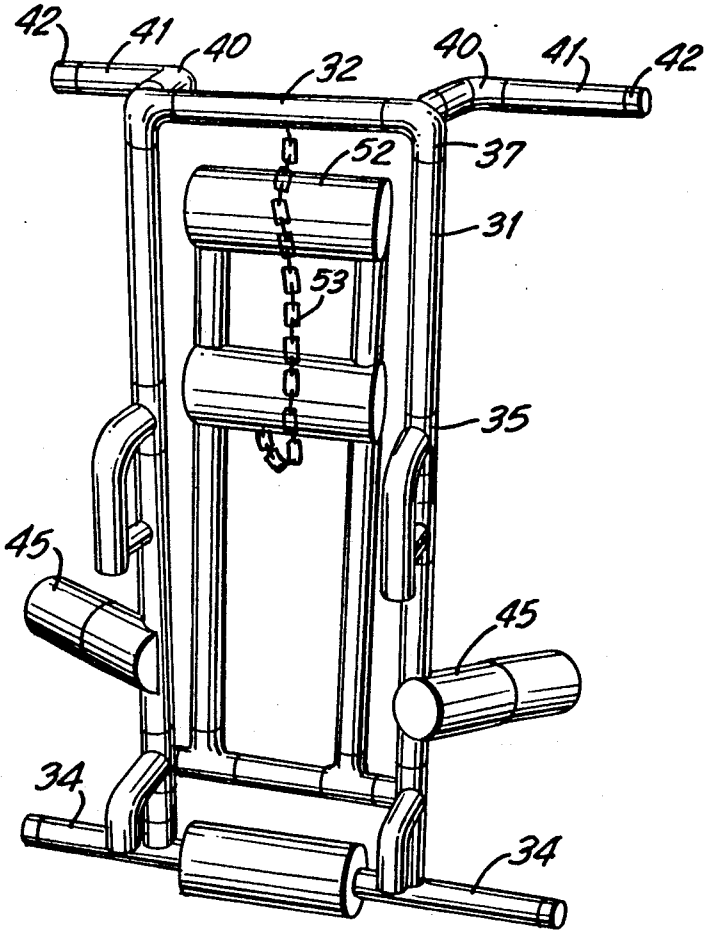
FIG. 5 is a rear view of the apparatus again with its platform in the raised position.

FIG. 5 is a rear view of exercise apparatus 30. J-hooks 35 are clearly shown as well as extension 35A, and swivel fittings 35B, keeping in mind that swivel fittings 35B may be rotated freely from the position shown.

Figure 6:
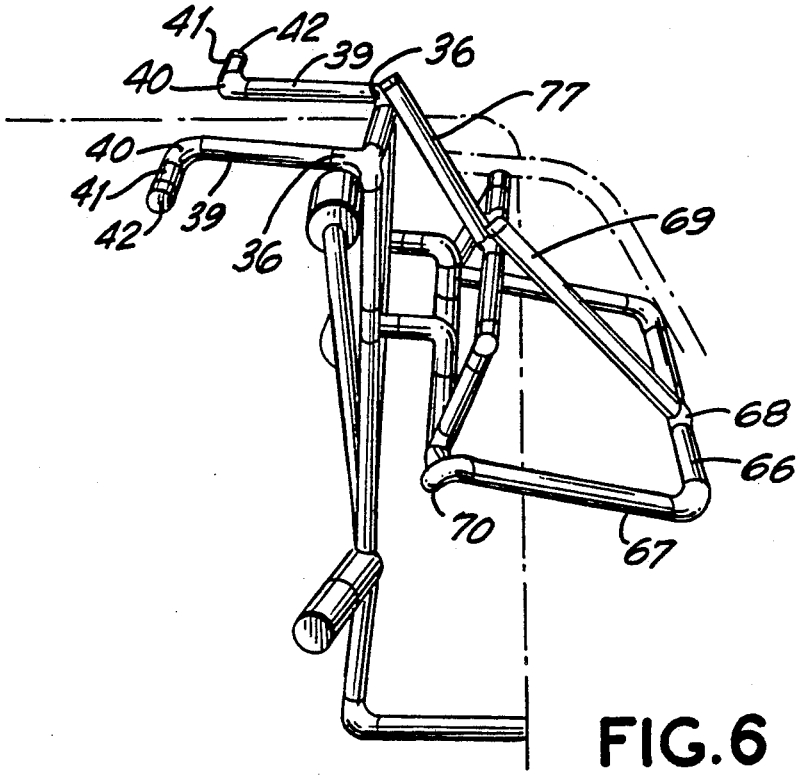
FIG. 6 is a perspective view taken at a different angle from that of FIG. 2 showing it mounted to an inverted ladder.

FIG. 6 is a perspective view taken at a different angle from that shown in FIG. 2. Support frame 65 is shown in its locked position and exercise apparatus 30 is shown immersed in the water with platform 46 shown in its upright or stowed position.

Figure 7:
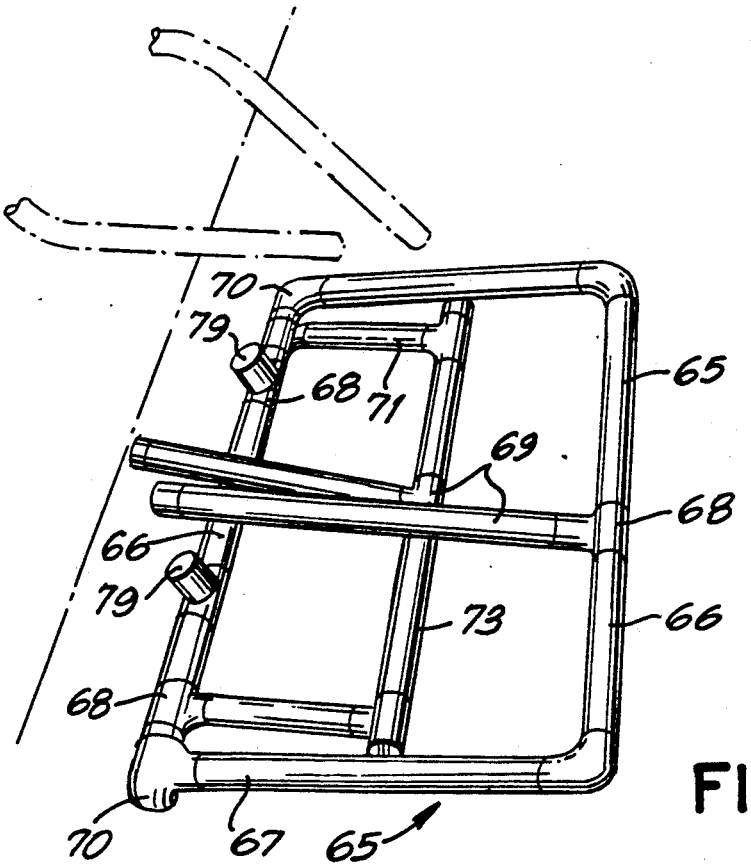
FIG. 7 is a semi-plan view of the adapter required for the aquatic exercise apparatus when used with the inverted ladder illustrated therein.

FIG. 7 is an illustration of support frame 65 prior to its being placed inside inverted ladder 60. Support frame 65 is collapsible into the position illustrated for purposes of storing or shipping.

Although the exercise apparatus has been shown and described in conjunction with a swimming pool, it is equally adaptable with a dock or pier. Further, frequent mention has been made of the use of PVC in conjunction with the tubular members. However, conventional tubing made of stainless steel or other corrosion resistent material may be used as well.

As can be seen from the above drawings and description the safety of the user has been kept in mind in designing the apparatus. For example, no sharp edges are present whereby one may be cut or injured when using the device.

The foregoing is considered as illustrative only of the principles of the invention. Further, since various modifications and changes may readily occur to those skilled in the art, it is not desired to limit the exact construction and operation shown and described, and accordingly, all suitable modifications and equivalents may be resorted to as falling within the scope of the invention as claimed.

Having thus described my invention, I claim.

1. An aquatic exercise apparatus for swimming pool use, at least in part below the pool water, comprising:

a mainframe having upper and lower portions, said frame being in a generally vertical plane, said plane having a forward surface and back surface, a support extending from said upper portion of same mainframe, an exercise platform having first and second ends, said first end being pivotally fitted to said lower portion of said mainframe along a pivot axis, said exercise platform being rotatable between a horizontal position and a vertical position about said pivot axis, said second end being in proximity to said upper portion of said mainframe when said exercise platform is in said vertical position, said horizontal position being approximately at an angle of ninety degrees to said vertical plane of said mainframe, adjustment holding means for positioning said exercise platform in selected positions between said vertical position and said horizontal position and for holding said exercise platform in said horizontal position, a first pair of laterally outwardly extending arms connected to said upper portion of said mainframe, and a second pair of laterally outwardly extending arms connected to said lower portion of said mainframe at a position in proximity to and above said pivot axis of said platform.

2. The exercise apparatus of claim 1 further comprising: a third pair of laterally outwardly extending arms connected to said mainframe at a position in proximity to and below said pivot axis of said platform.

3. The exercise apparatus of claim 1 wherein said adjustment holding means is a flexible support member extending between said second end of said platform and said upper portion of said mainframe.

4. The exercise apparatus of claim 2 wherein said adjustment holding means is a flexible support member extending between said second end of said platform and said upper portion of said mainframe.

5. The exercise apparatus of claim 1 wherein said upper portion of said mainframe includes: a pair of forwardly extending supports, each of said first pair of arms being connected to a forward portion of one of said supports, said first pair of arms being positioned forward of said vertical plane of said mainframe by said supports.

6. The exercise apparatus of claim 2 wherein said upper portion of said mainframe includes: a pair of forwardly extending supports, each of said first pair of arms being connected to a forward portion of one of said supports, said first pair of arms being positioned forward of said vertical plane of said mainframe by said supports.

7. The exercise apparatus of claim 3 wherein said upper portion of said mainframe includes: a pair of forwardly extending supports, each of said first pair of arms being connected to a forward portion of one of said supports, said first pair of arms being positioned forward of said vertical plane of said mainframe by said supports.

8. The exercise apparatus of claim 4 wherein said upper portion of said mainframe includes: a pair of forwardly extending supports, each of said first pair of arms being connected to a forward portion of one of said supports, said first pair of arms being positioned forward of said vertical plane of said mainframe by said supports.

9. The exercise apparatus of claim 1 wherein said second pair of arms are canted forward, whereby the outboard ends of said second pair of arms are forward of the inboard ends of said arms.

10. The exercise apparatus of claim 2 wherein said second pair of arms are canted forward, whereby the outboard ends of said second pair of arms are forward of the inboard ends of said arms.

11. The exercise apparatus of claim 4 wherein said second pair of arms are canted forward, whereby the outboard ends of said second pair of arms are forward of the inboard ends of said arms.

12. The exercise apparatus of claim 8 wherein said second pair of arms are canted forward, whereby the outboard ends of said second pair of arms are forward of the inboard ends of said arms.

13. The exercise apparatus of claim 1 further comprising: support means connected to the lower portion of said frame and extending rearward of said frame to contact a pool wall.

14. The exercise apparatus of claim 2 further comprising: support means connected to the lower portion of said frame and extending rearward of said frame to contact a pool wall.

15. The exercise apparatus of claim 4 further comprising: support means connected to the lower portion of said frame and extending rearward of said frame to contact a pool wall.

16. The exercise apparatus of claim 8 further comprising: support means connected to the lower portion of said frame and extending rearward of said frame to contact to a pool wall.

17. The exercise apparatus of claim 12 further comprising: support means connected to the lower portion of said frame and extending rearward of said frame to contact a pool wall.

* * * * *